US007794664B2

(12) United States Patent
Pelletier et al.

(10) Patent No.: US 7,794,664 B2
(45) Date of Patent: Sep. 14, 2010

(54) PIPETTE TIP

(75) Inventors: Dominic Pelletier, Raymond, ME (US); Jeffrey Phelps, Freeport, ME (US); Jason Aguiar, Portland, ME (US); Jeremy Hammond, Gorham, ME (US); William J. Traigle, Biddeford, ME (US); Chandler G. Sinnett, Falmouth, ME (US)

(73) Assignee: IDEXX Laboratories, Inc., Westbrook, ME (US)

( * ) Notice: Subject to any disclaimer, the term of this patent is extended or adjusted under 35 U.S.C. 154(b) by 260 days.

(21) Appl. No.: 11/985,439

(22) Filed: Nov. 15, 2007

(65) Prior Publication Data

US 2008/0131326 A1 Jun. 5, 2008

Related U.S. Application Data

(60) Provisional application No. 60/859,308, filed on Nov. 16, 2006.

(51) Int. Cl.
*B01L 3/02* (2006.01)

(52) U.S. Cl. ..... 422/100; 73/863.32; 73/864.01

(58) Field of Classification Search ..... 422/100
See application file for complete search history.

(56) References Cited

U.S. PATENT DOCUMENTS

| | | | | |
|---|---|---|---|---|
| 4,020,698 | A | 5/1977 | Marteau D'Autry | 73/425.6 |
| 4,325,913 | A | 4/1982 | Wardlaw | 422/100 |
| 4,347,875 | A | 9/1982 | Columbus | 141/18 |
| 4,461,185 | A | 7/1984 | Schoffel | 73/864.01 |
| 4,483,825 | A | 11/1984 | Fatches | 422/100 |
| 4,616,514 | A | 10/1986 | Magnussen, Jr. et al. | 73/864.14 |
| 4,622,847 | A | 11/1986 | Paoletti et al. | 73/61.4 |
| 4,748,859 | A | 6/1988 | Magnussen, Jr. et al. | 73/864.01 |

(Continued)

FOREIGN PATENT DOCUMENTS

| | | |
|---|---|---|
| WO | WO2006093925 | 9/2006 |

(Continued)

OTHER PUBLICATIONS

May 20, 2008, PCT Notification of Transmittal of the International Search Report and the Written Opinion of the International Searching Authority, or the Declaration; International Search Report; and Written Opinion of the International Searching Authority relating to corresponding PCT application having Serial No. PCT/US07/24035.

*Primary Examiner*—Jill Warden
*Assistant Examiner*—Jennifer Wecker
(74) *Attorney, Agent, or Firm*—Gerald T. Bodner

(57) ABSTRACT

A pipette tip includes a main body having an upper end, a lower end and a sidewall extending between the two ends. A bore extends axially through the main body between the upper and lower ends. The lower end has a bottom surface in which is formed a central opening that communicates with the axial bore to allow the passage of fluid therethrough. The bottom surface is formed with at least one groove that may be concentrically disposed or spirally disposed about the central opening. The at least one groove acts to inhibit fluid passing through the central opening from at least partially flowing along the outer surface of the sidewall from the central opening toward the upper end of the main body of the pipette tip.

20 Claims, 6 Drawing Sheets

U.S. PATENT DOCUMENTS 4,961,350 A 10/1990 Tennstedt ..... 73/864.01
4,971,763 A 11/1990 Columbus ..... 422/100
4,982,577 A 1/1991 Milankov et al. ..... 62/381
4,988,481 A 1/1991 Jarvimaki et al. ..... 422/100
5,026,526 A 6/1991 Quenin et al. ..... 422/64
5,073,347 A 12/1991 Garren et al. ..... 422/100
5,089,229 A 2/1992 Heidt et al. ..... 422/64
5,121,642 A 6/1992 Davidowicz et al. ..... 73/864.11
5,159,842 A 11/1992 Palmer et al. ..... 73/864.01
5,192,511 A 3/1993 Roach ..... 422/100
5,200,151 A 4/1993 Long ..... 422/100
5,212,992 A 5/1993 Calhoun et al. ..... 73/864.01
5,217,693 A 6/1993 Anderson et al. ..... 422/100
5,218,875 A 6/1993 Volpe et al. ..... 73/864.01
5,232,669 A * 8/1993 Pardinas ..... 422/100
5,250,262 A 10/1993 Heidt et al. ..... 422/64
5,260,030 A 11/1993 DeVaughn ..... 422/100
5,324,480 A 6/1994 Shumate et al. ..... 422/63
5,336,467 A 8/1994 Heidt et al. ..... 422/64
5,354,537 A 10/1994 Moreno ..... 422/100
5,468,453 A 11/1995 Holt et al. ..... 422/100
5,550,059 A 8/1996 Boger et al. ..... 436/54
5,556,598 A 9/1996 Raybuck et al. ..... 422/10 D
5,807,524 A 9/1998 Kelly et al. ..... 422/100
D401,698 S 11/1998 Daniels ..... D24/222
5,855,851 A 1/1999 Matsubara et al. ..... 422/100
5,918,291 A 6/1999 Inacue et al. ..... 73/863.83
6,021,680 A 2/2000 Inagaki et al. ..... 73/864.17
6,066,297 A 5/2000 Torti et al. ..... 422/100
6,197,259 B1 3/2001 Kelly et al. ..... 422/100
6,203,083 B1 3/2001 Reimann ..... 294/64.1
6,248,295 B1 6/2001 Petrek ..... 422/100
6,280,689 B1 8/2001 Stevens ..... 422/100
6,299,841 B1 10/2001 Rainin et al. ..... 422/100
6,343,717 B1 2/2002 Zhang et al. ..... 222/209
6,428,750 B1 8/2002 Rainin et al. ..... 422/100
6,431,015 B1 8/2002 Hodac et al. ..... 73/864.01
6,457,612 B1 10/2002 Zhang et al. ..... 222/465.1
6,532,837 B1 3/2003 Magussen, Jr. et al. ... 73/864.14
6,551,557 B1 4/2003 Rose et al. ..... 422/100
6,551,558 B1 4/2003 Mann et al. ..... 422/100
6,566,145 B2 5/2003 Brewer ..... 436/178
6,723,289 B2 4/2004 Iheme et al. ..... 422/100
6,806,094 B2 * 10/2004 Anderson et al. ..... 436/180
6,814,936 B1 11/2004 Enhorning ..... 422/100
6,824,024 B2 11/2004 Ingenhoven et al. ..... 222/504
6,837,119 B2 1/2005 Blackwood-Sewell ... 73/864.01
6,837,942 B2 1/2005 Joslyn ..... 134/18
6,923,938 B2 8/2005 Cote et al. ..... 422/100
6,931,948 B2 8/2005 Doi et al. ..... 73/864.18
6,945,128 B2 9/2005 Ford et al. ..... 73/864.16
6,955,077 B2 10/2005 Blaszcak et al. ..... 73/73
6,959,616 B2 11/2005 Viot ..... 73/864.18
6,976,383 B2 12/2005 Petro et al. ..... 73/61.55
6,977,062 B2 12/2005 Cronenberg ..... 422/100
7,007,562 B2 3/2006 Judic ..... 73/864.01
7,033,543 B1 4/2006 Panzer et al. ..... 422/100
7,047,828 B2 5/2006 Blaszcak et al. ..... 73/864.01
7,077,018 B2 7/2006 Sinclair ..... 73/864.13
7,105,130 B2 9/2006 Telimaa et al. ..... 422/100
2001/0017060 A1 8/2001 Offen et al. ..... 73/863.11
2002/0094302 A1 * 7/2002 Taggart et al. ..... 422/100
2005/0204832 A1 9/2005 Jessop ..... 73/864.01

FOREIGN PATENT DOCUMENTS

WO WO 2006093925 A2 * 9/2006

* cited by examiner

PIPETTE TIP

CROSS REFERENCE TO RELATED APPLICATION

This application is related to U.S. Provisional Application Ser. No. 60/859,308, filed on Nov. 16, 2006, and entitled "Pipette Tip", the disclosure of which is incorporated herein by reference and on which priority is hereby claimed.

BACKGROUND OF THE INVENTION

1. Field of the Invention

This invention relates to pipette tips capable of dispensing fluids, and more specifically relates to pipette tips used in wet and dry chemical analyzers capable of precisely dispensing minute quantities of fluid.

2. Description of the Prior Art

FIGS. 1, 2 and 3 are various views of a conventional pipette 2 incorporated in the VetTest® veterinary blood analyzer marketed by IDEXX Laboratories, Inc. of Westbrook, Me. The conventional pipette includes a main body 4 having a central bore 6 extending axially therethrough and a dispensing tip 8. The dispensing tip 8, having a distal tip end 9, opposite proximal end 11 and sidewall 13, has a circular opening 10 formed in the bottom surface of the distal end 9 leading to the central bore 6 of the pipette main body 4. Fluid is dispensed from the central bore 6 out the circular opening 10 by means of pneumatic force. The structure and operation of this pipette is more fully described in U.S. Pat. Nos. 5,089,229; 5,250,262; and 5,336,467, each of which issued to Thomas Heidt et al., the disclosures of which are incorporated herein by reference.

The VetTest® system is used to apply body fluid, e.g., urine, serum and/or plasma onto test slides having a chemical or biological reagent on their surface. The conventional pipette 2 automatically distributes amounts of fluid onto a plurality of test slides, each of which may have a different reagent coating. A minor concern with the VetTest® apparatus is that occasionally there is a spot failure (i.e., an improper application of serum/plasma to a slide). This infrequent spot failure may result from inconsistent volumes of fluid or no fluid being deposited on the test slides. Spot failure has been at least partially traced to the design of the pipette tip and the material (i.e., polypropylene) from which the dispensing tip 8 of the pipette is preferably made.

As a specific quantity of fluid is dispensed from the dispensing tip 8 of the conventional pipette 2, the fluid dynamics cause a generally spherical droplet to form at the circular opening 10. As the droplet nears the desired volume, the pipette 2 is lowered toward the slide until the droplet just contacts the chemically coated film portion of the slide, whereupon it is drawn from the dispensing tip 8 of the pipette 2 due to capillary action, surface tension and gravitational force on the droplet. Unfortunately, the ability to control the exact amount of fluid dispensed onto a test slide is difficult, as occasionally small amounts of the droplet are drawn up over the outer surface of the distal tip end 9 of dispensing tip 8, which is due at least in part to the propensity of the polypropylene pipette tip 8 to "wet" or attract fluid on the outer surface of the pipette tip. Wetting the outer surface may cause an imprecise volumetric quantity of fluid or no fluid to be deposited on the test slide.

OBJECTS AND SUMMARY OF THE INVENTION

It is an object of the present invention to provide a pipette capable of dispensing precise amounts of fluid.

It is another object of the present invention to provide a pipette capable of dispensing precise amounts of fluid onto a reagent test slide or into a vial containing a chemical reagent.

It is yet another object of the present invention to provide a pipette which eliminates or at least minimizes improper volume dispensing of fluid samples.

In accordance with one form of the present invention, a pipette tip for depositing a fluid sample onto a chemical reagent test slide or into a vial containing a chemical reagent includes an enlarged bottom surface having a central opening through which the sample fluid may selectively flow. The increased surface area serves to inhibit fluid from reaching and/or traveling up the outer side of the pipette. In another form of the invention, the bottom surface is formed with one or more grooves disposed concentrically or spirally about the central opening. The grooves may be of any dimension, e.g. V-shaped or rectangular in cross-section, and inhibit the droplet of sample fluid from flowing along the bottom surface and, therefore, from traveling up the outer surface of the sidewall of the pipette tip, thus minimizing improper volume dispensing of the sample fluid onto the chemical reagent test slide or into the vial containing a chemical reagent. Clearly, this added fluid control can have applications outside the field of chemical reagent slide spotting, such as, for example, wet and dry chemistries, microbiology applications, including genetics testing, commercial processes and the like.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
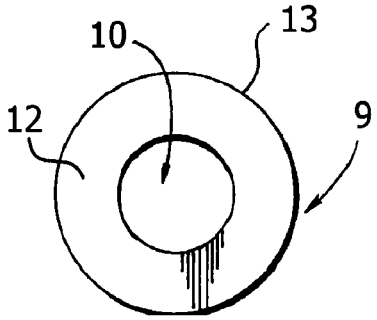
Fig. 1 (Prior Art)
FIG. 1 is a bottom view of the tip of a conventional fluid metering pipette tip used in a chemical analyzer.
Figure 2:
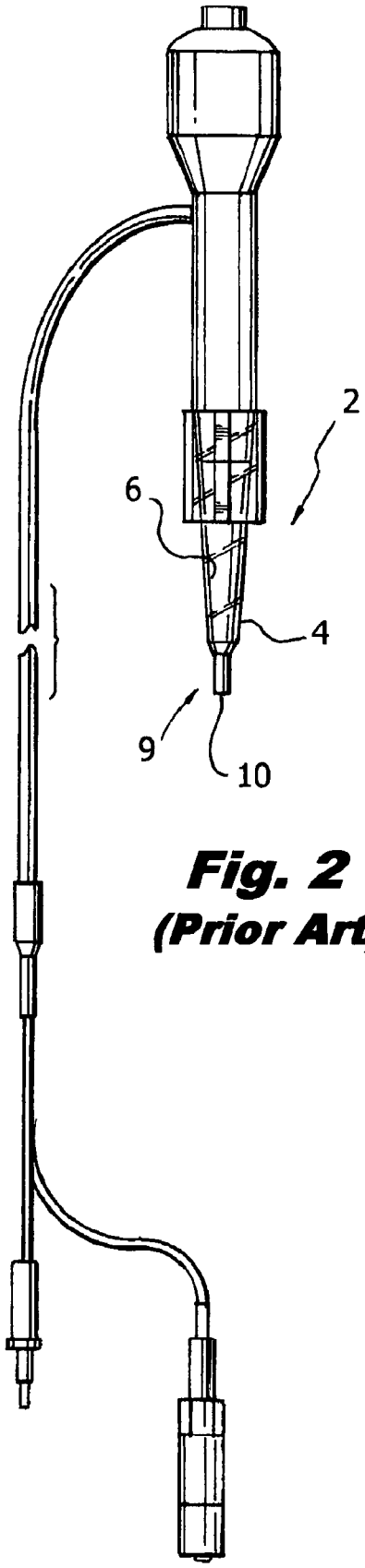
Fig. 2 (Prior Art)
FIG. 2 is a perspective view of a conventional pipette used to deposit blood serum or plasma onto a chemical reagent test slide or into a vial containing a chemical reagent.

The present invention is an improvement over the conventional pipette tip 8 used in the VetTest® a veterinary blood analyzer described previously and in the aforementioned Heidt et al. patents (U.S. Pat. Nos. 5,089,229; 5,250,262; and 5,336,467), the disclosures of which are incorporated herein by reference.

With reference to FIGS. 3A-31, the present invention includes a disposable pipette tip 14 that is fitted onto the end of the conventional pipette 2. The pipette tip 14 has a main body that includes an upper end 18, an opposite lower end 20, a sidewall 16 having an outer surface and extending between the upper and lower ends 18, 20, and a central bore 22 extending axially therethrough. The tip 14 converges radially inwardly from the upper end 18 toward the lower end 20, the lower end 20 being narrower in diameter than the upper end 18. The lower end 20 has a bottom surface 23 formed with a central opening 24 which communicates with the axial bore 22 to allow sample fluid to pass therethrough. The upper end 18, being opposite the lower end 20, may include a plurality of radially outwardly extending supporting fins (not shown), as in the conventional pipette tip described in the Heidt et al. patents.

Figure 29:
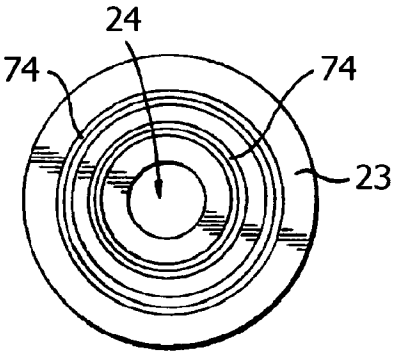
FIG. 29 is a bottom view of the pipette tip of the present invention shown in FIG. 28.
Figure 30:
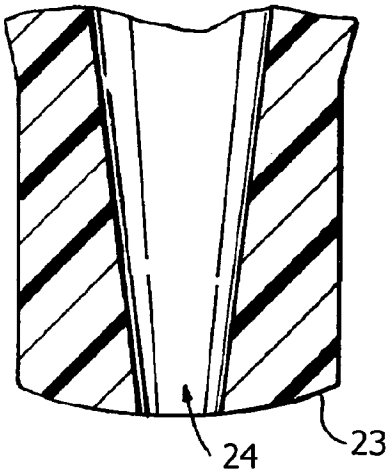
FIG. 30 is a longitudinal cross-sectional view of the tip portion of a fluid metering pipette constructed in accordance with an alternate form of the present invention.
Figure 31:
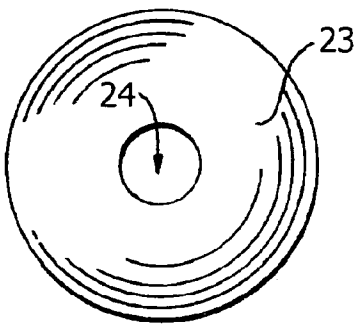
FIG. 31 is a bottom view of the pipette tip of the present invention shown in FIG. 30.

In accordance with the present invention, the bottom surface 23 of the pipette tip 14 is either enlarged and/or includes one or more grooves or cuts formed therein. The grooves or cuts can be formed by molding, milling, stamping, cutting or other similar means. When present, the grooves may vary in depth, shape and dimension, and may be concentric with the central opening 24 at the bottom surface 23 or may be spirally disposed on the bottom surface 23. Additionally, the grooves may be continuous circumferentially about the central opening 24, or may be intermittent, arcuate segments spaced circumferentially from each other about the central opening 24. Also the pipette bottom surface can be generally flat (as shown in FIGS. 3A-29) or can be convex in profile (as shown in FIGS. 30-31) with or without one or more grooves or other means for inhibiting radial fluid flow from central opening 24.

Figure 3:
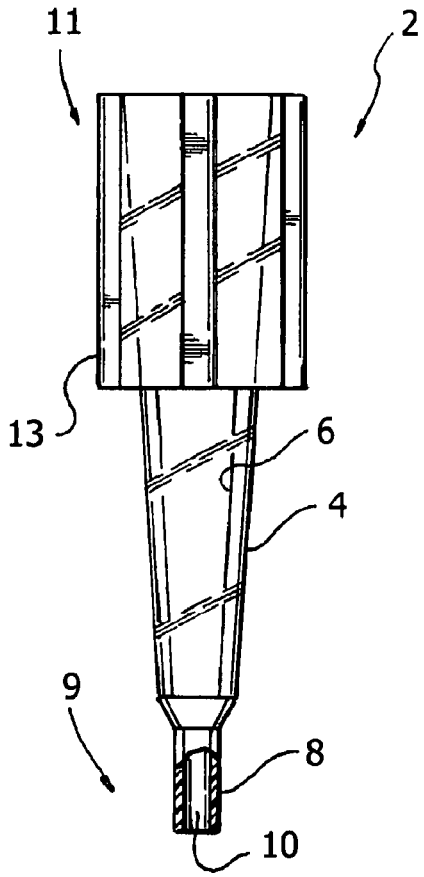
Fig. 3 (Prior Art)
FIG. 3 is a detailed longitudinal cross-sectional view of the distal end of the pipette shown in FIG. 2.
Figure 3A:
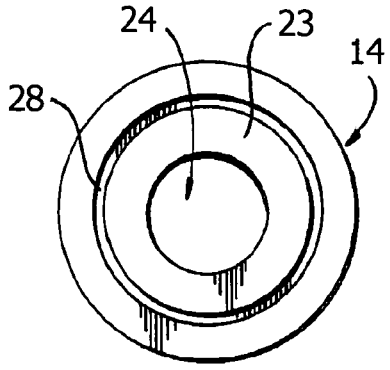
FIG. 3A is a bottom view of a pipette tip of the present invention having a single groove.
Figure 3B:
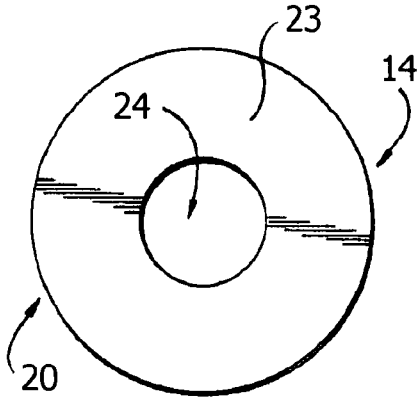
FIG. 3B is a bottom view of an alternate pipette tip of the present invention having an enlarged bottom surface.

For example, as illustrated in FIG. 3A, pipette tip 14 has preferably the same inner/outer dimensions as prior art tips (e.g. FIG. 1, opening diameter being about 0.030 inches, outer tip diameter being about 0.0685 inches) but also includes groove 28. Pipette tip 14 in FIG. 3B has no groove but has an enlarged outer diameter to inhibit, impede or otherwise reduce fluid flow between opening 24 and the exterior of lower end 20. In a preferred embodiment, the inner diameter of opening 24 in FIG. 3B is about 0.030 inches, while the outer tip diameter is between about 0.069 inches and about 0.115 inches).

Figure 4:
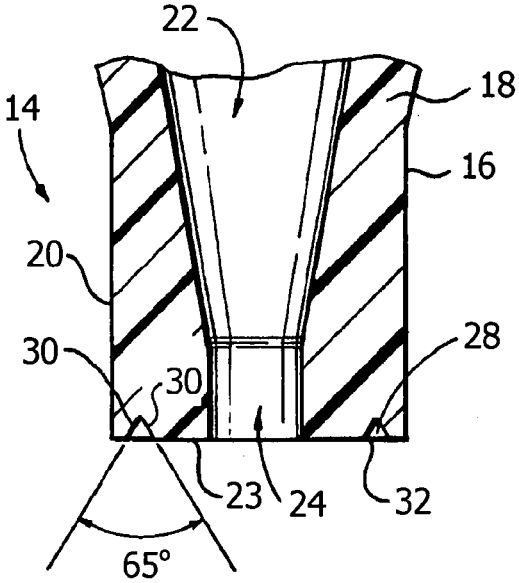
FIG. 4 is a longitudinal cross-sectional view of the tip portion of a fluid metering pipette constructed in accordance with an alternate form of the present invention.
Figure 5:
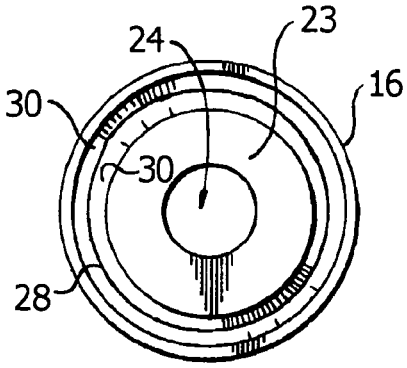
FIG. 5 is a bottom view of the pipette tip of the present invention shown in FIG. 4.

Turning to FIGS. 4 and 5, the bottom surface 23 of the lower end 20 of the pipette tip, in accordance with one embodiment of the present invention, may have one or more similarly dimensioned, triangular or V-shaped grooves 28 (when viewed in cross-section) cut in the bottom surface 23, concentrically disposed (or spirally disposed) about the central opening 24. The triangular groove or grooves 28 may have two opposite sidewalls 30 separated by an angle of preferably about sixty-five (65) degrees that diverge from the apex of the groove to form an opening 32 of preferably about 0.0080 inches in the bottom surface 23. The triangular groove 28 may be cut into the bottom surface 23 to a variety of depths, but is preferably cut to a depth of about 0.0063 inches. If one groove 28 is used, as shown in FIGS. 4 and 5, the radially inner edge of the groove opening 32 formed in the bottom surface 23 is preferably at a radius of about 0.0355 inches from the center of the pipette tip 14.

Figure 6:
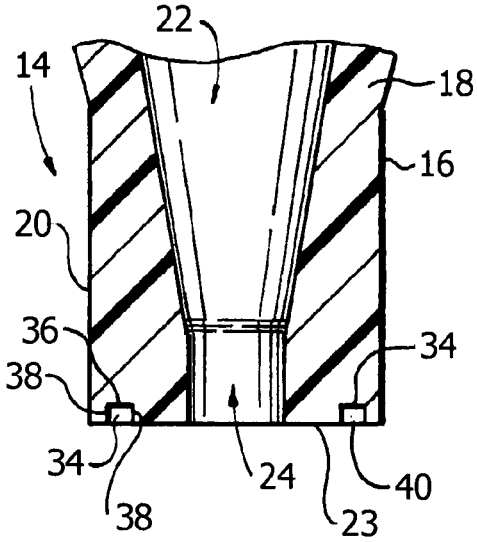
FIG. 6 is a longitudinal cross-sectional view of the tip portion of a fluid metering pipette constructed in accordance with an alternate form of the present invention.
Figure 7:
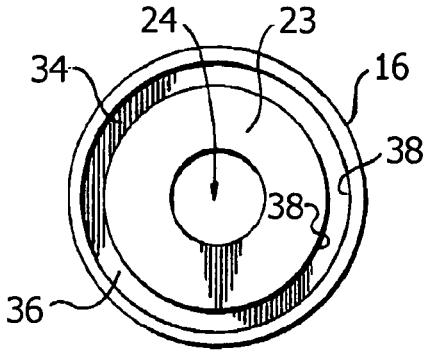
FIG. 7 is a bottom view of the pipette tip of the present invention shown in FIG. 6.

In another embodiment of the present invention, as illustrated in FIGS. 6 and 7, the bottom surface 23 of the lower end 20 of the pipette tip may have one or more square shaped grooves 34 (when viewed in cross-section) cut in the bottom surface 23, concentrically disposed (or spirally disposed) about the central opening 24. The square groove or grooves 34 may include a recessed upper wall 36, two lateral sidewalls 38 and an opening 40 in the bottom surface 23. The two sidewalls 38 are preferably separated by about 0.0080 inches. Like the previous embodiment of the present invention shown in FIGS. 4 and 5, the square groove or grooves 34 may be cut into the bottom surface 23 to a variety of depths, but is preferably cut to a depth of about 0.0060 inches. If one groove 34 is used, as shown in FIGS. 6 and 7, the radially inner edge at the groove opening 40 formed in the bottom surface 23 is preferably at a radius of about 0.0355 inches from the center of the pipette tip 14.

Figure 8:
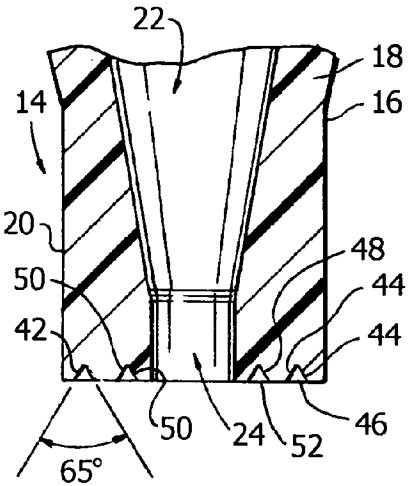
FIG. 8 is a longitudinal cross-sectional view of the tip portion of a fluid metering pipette constructed in accordance with an alternate form of the present invention.
Figure 9:
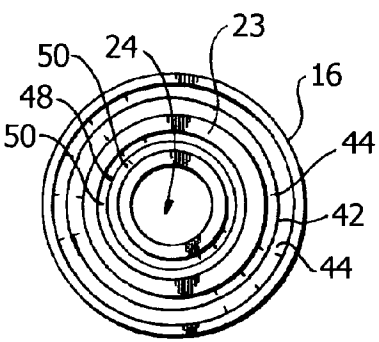
FIG. 9 is a bottom view of the pipette tip of the present invention shown in FIG. 8.

In yet another form of the present invention, as illustrated in FIGS. 8 and 9, the bottom surface 23 may have a plurality of differently dimensioned, triangular or V-shaped grooves (preferably two), cut in the bottom surface 23 of the pipette tip, concentrically disposed about the central opening 24. A radially outer triangular groove 42 may have two opposite sidewalls 44 separated by an angle of preferably about sixty-five (65) degrees that diverge from the apex of the groove 42 to form an opening 46 of preferably about 0.0076 inches in the bottom surface 23. The outer triangular groove 42 may be cut into the bottom surface 23 to a variety of depths, but is preferably cut to a depth of about 0.0060 inches. A radially inner triangular groove 48 may have two opposite sidewalls 50 separated by an angle of preferably about sixty-five (65) degrees that diverge from the apex of the groove 48 to form an opening 52 of preferably about 0.0062 inches in the bottom surface 23. The inner triangular groove 48 may be cut into the bottom surface 23 to a variety of depths, but is preferably cut to a depth of about 0.0048 inches. The radially inner edge of outer groove opening 46 formed in the bottom surface 23 is preferably at a radius of about 0.0361 inches from the center of the pipette tip 14, and the radially inner edge of inner groove opening 52 formed in the bottom surface 23 is preferably at a radius of about 0.0232 inches also measured from the center of the pipette tip 14.

In each of the embodiments of the present invention described above and shown in FIGS. 4-9, the lower end 20 and bottom surface 23 thereof was enlarged to accommodate the groove or grooves, and preferably has an outer diameter of about 0.0970 inches. The central opening 24 preferably has a diameter of about 0.0310 inches. However, as shown in FIG. 3A, enlargement of bottom surface 23 is not required.

Figure 10:
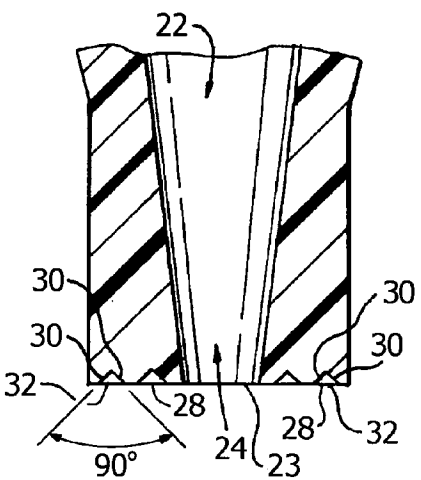
FIG. 10 is a longitudinal cross-sectional view of the tip portion of a fluid metering pipette constructed in accordance with an alternate form of the present invention.
Figure 11:
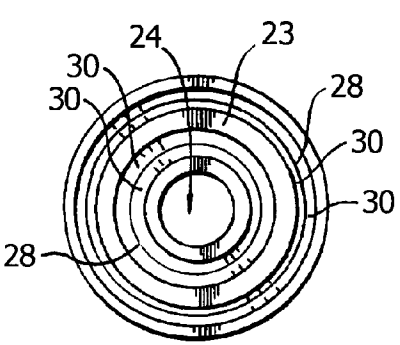
FIG. 11 is a bottom view of the pipette tip of the present invention shown in FIG. 10.

A further form of the present invention is illustrated in FIGS. 10 and 11 of the drawings. In this embodiment, the bottom surface 23 includes one or more similarly dimensioned, triangular or V-shaped grooves 28 (when viewed in cross-section) formed in the bottom surface 23, and concentrically disposed about the central opening 24. This embodiment is similar to that shown in FIGS. 4 and 5, except that the dimensions of the bottom surface 23, the central opening 24 and the V-shaped grooves are different.

More specifically, the triangular groove or grooves 28 may have two opposite sidewalls 30 separated by an angle of preferably about ninety (90) degrees that diverge from the apex of the groove to form an opening 32 of preferably about 0.0100 inches in the bottom surface 23. The triangular groove 28 may be cut into the bottom surface 23 to a depth of about 0.0050 inches.

In the embodiment of the present invention illustrated in FIGS. 10 and 11 of the drawings, the radius of the tip opening 24 is preferably about 0.0150 inches, and the outer periphery of the bottom surface 23 has a radius of about 0.0525 inches. The inner edge of the opening 32 of the innermost groove preferably has a radius of about 0.0225 inches, and the inner edge of the opening 32 of the outermost groove preferably has a radius of about 0.0350 inches.

Figure 12:
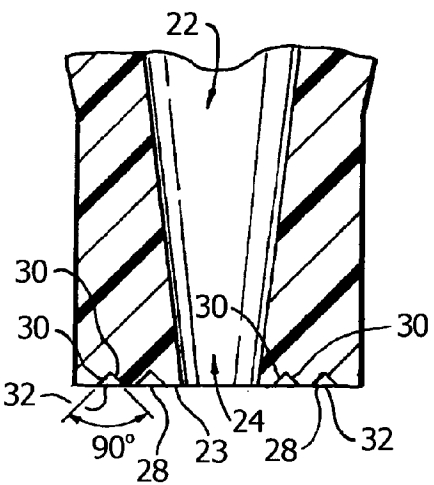
FIG. 12 is a longitudinal cross-sectional view of the tip portion of a fluid metering pipette constructed in accordance with an alternate form of the present invention.
Figure 13:
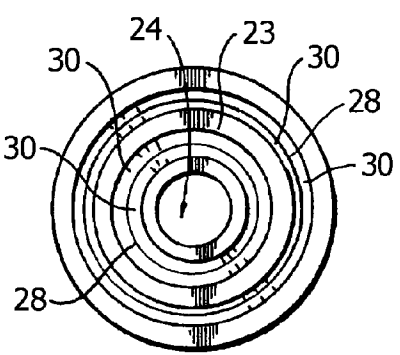
FIG. 13 is a bottom view of the pipette tip of the present invention shown in FIG. 12.

FIGS. 12 and 13 illustrate another embodiment of the pipette tip of the present invention which is similar in many respects to the embodiment of the pipette tip shown in FIGS. 10 and 11; however, the dimensions of the embodiment shown in FIGS. 12 and 13 differ from those of the embodiment shown in FIGS. 10 and 11.

More specifically, and referring to FIGS. 12 and 13 of the drawings, the pipette tip is preferably formed with a central opening 24 in its bottom surface 23 having a preferred radius of about 0.0150 inches, as in the embodiments shown in FIGS. 10 and 11, but the outer radius of the bottom surface 23 of the pipette tip differs from that shown in FIGS. 10 and 11 in that the bottom surface 23 has a preferred outer diameter of about 0.0575 inches. Also, the dimensions of the V-shaped or triangular grooves 28 formed concentrically in the bottom surface 23 of the pipette tip are substantially the same as those of the embodiment illustrated in FIGS. 10 and 11 of the drawings; however, the inner edge of the opening 32 defined in the bottom surface 23 of the innermost groove preferably has a radius of about 0.0250 inches, and the inner edge of the opening 32 defined in the bottom surface 23 by the outermost groove preferably has a radius of about 0.0375 inches.

Figure 14:
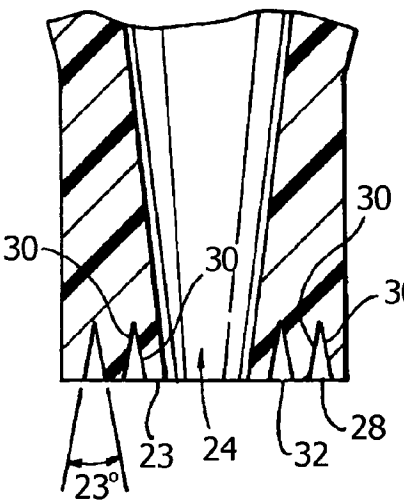
FIG. 14 is a longitudinal cross-sectional view of the tip portion of a fluid metering pipette constructed in accordance with an alternate form of the present invention.
Figure 15:
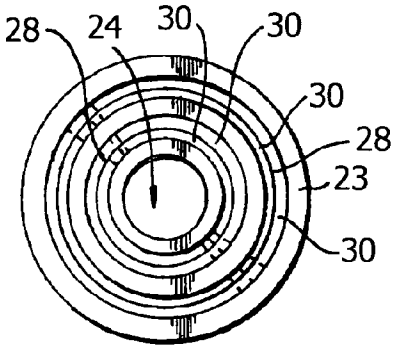
FIG. 15 is a bottom view of the pipette tip of the present invention shown in FIG. 14.

FIGS. 14 and 15 illustrate another embodiment of the pipette tip of the present invention in which one or more deeper grooves 28, which are preferably triangular or V-shaped in cross-section, are formed in the bottom surface 23 of the pipette tip and concentrically disposed about the central opening 24. More specifically, the triangular groove or grooves 28 may have two opposite sidewalls 30 separate by an angle of preferably about twenty-three (23) degrees that diverge from the apex of the groove to form an opening 32 of preferably about 0.008 inches in the bottom surface 23. The triangular groove or grooves 28 are preferably cut into the bottom surface 23 to a depth of about 0.020 inches.

In the embodiment of the present invention illustrated in FIGS. 14 and 15 of the drawings, the diameter of the tip opening 24 is preferably about 0.030 inches, and the outer periphery of the bottom surface 23 has a diameter of about 0.105 inches. The inner edge of the opening 32 of the innermost groove preferably has a radius of about 0.024 inches, and the inner edge of the opening 32 of the outermost groove preferably has a radius of about 0.036 inches.

Figure 16:
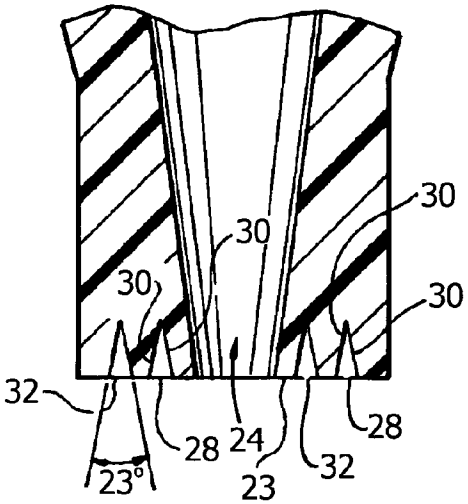
FIG. 16 is a longitudinal cross-sectional view of the tip portion of a fluid metering pipette constructed in accordance with an alternate form of the present invention.
Figure 17:
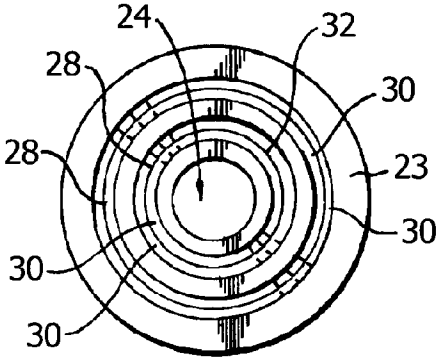
FIG. 17 is a bottom view of the pipette tip of the present invention shown in FIG. 16.

FIGS. 16 and 17 illustrate yet another embodiment of the pipette tip of the present invention which is similar in many respects to the embodiment of the pipette tip shown in FIGS. 14 and 15. The outer diameter of the bottom surface 23 is preferably about 0.115 inches, while the diameter of the tip opening 24 is preferably about 0.030 inches. Again, one or more triangular grooves 28 (when viewed in cross-section) are formed in the bottom surface 23 and are concentrically disposed about the central opening 24. The triangular groove or grooves 28 have two opposite sidewalls 30 separated by an angle of preferably about twenty-three (23) degrees that diverge from the apex of the groove to form an opening 32 of preferably about 0.008 inches in the bottom surface 23. The triangular groove or grooves 28 are preferably cut into the bottom surface 23 to a depth of about 0.020 inches.

In the embodiment shown in FIGS. 16 and 17 of the drawings, the inner edge of the opening 32 of the innermost groove preferably has a radius of about 0.026 inches, and the inner edge of the opening 32 of the outermost groove preferably has a radius of about 0.038 inches.

Figure 18:
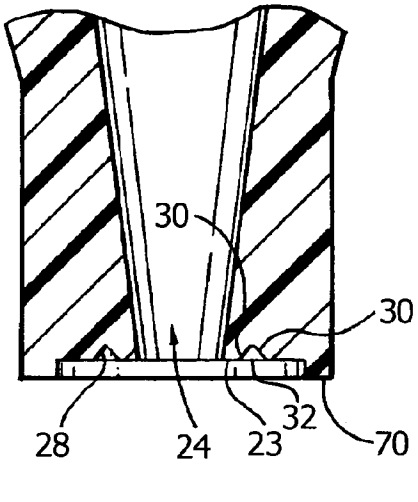
FIG. 18 is a longitudinal cross-sectional view of the tip portion of a fluid metering pipette constructed in accordance with an alternate form of the present invention.
Figure 19:
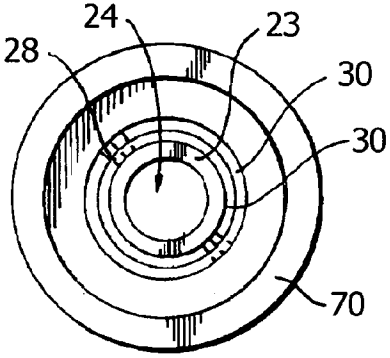
FIG. 19 is a bottom view of the pipette tip of the present invention shown in FIG. 18.

FIGS. 18 and 19 illustrate yet another embodiment of the pipette tip formed in accordance with the present invention. In this embodiment, a drip edge 70 is included which surrounds the periphery of the bottom surface 23 and extends outwardly axially therefrom. Preferably, the drip edge 70 has a radial width of about 0.0100 inches, and extends from the bottom surface 23 of the pipette tip a distance of about 0.0050 inches.

In the embodiment shown in FIGS. 18 and 19, a triangular or V-shaped groove 28 is formed in the bottom surface 23 and is concentrically disposed about the central opening 24. The triangular groove 28 has two opposite sidewalls 30 separated by an angle of preferably about ninety (90) degrees that diverge from the apex of the groove to form an opening 32 of preferably about 0.0100 inches in the bottom surface 23. The triangular groove 28 is preferably cut into the bottom surface 23 to a depth of about 0.0050 inches.

In the embodiment of the pipette tip shown in the FIGS. 18 and 19, the radius of the tip opening 24 is preferably about 0.0150 inches, and the outer diameter of the bottom surface 23 is about 0.1050 inches. The inner edge of the opening 32 of the groove 28 preferably has a radius of about 0.0250 inches, and the radially inner edge of the drip edge 70 preferably has a radius of about 0.0425 inches. The groove 28 and the drip edge 70 increase the effective surface area of the bottom surface 23 of the pipette tip between the central opening 24 and the outer edge of the bottom surface 23 to inhibit the flow of fluid passing through the central opening 24 of the pipette tip toward the outer edge of the bottom surface 23 and thereby minimizes the possibility of the fluid from traveling up the outer surface of the sidewall of the pipette tip.

Figure 20:
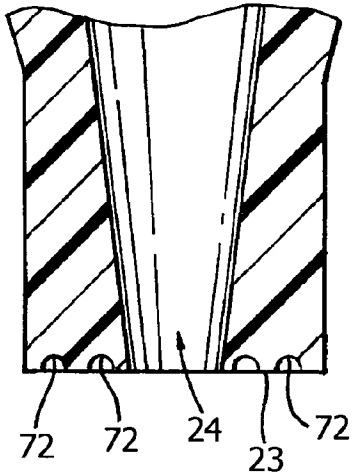
FIG. 20 is a longitudinal cross-sectional view of the tip portion of a fluid metering pipette constructed in accordance with an alternate form of the present invention.
Figure 21:
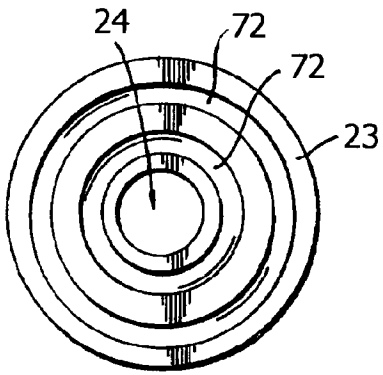
FIG. 21 is a bottom view of the pipette tip of the present invention shown in FIG. 20.

FIGS. 20 and 21 illustrate yet another embodiment of the pipette tip of the present invention, in which one or more half-round or semi-circular (in cross-section) grooves 72 are formed in the bottom surface 23 of the pipette tip. Again, the half-round grooves 72 may be concentrically disposed about the central opening 24, or may be non-concentrically disposed or spirally disposed about the central opening.

Figure 22:
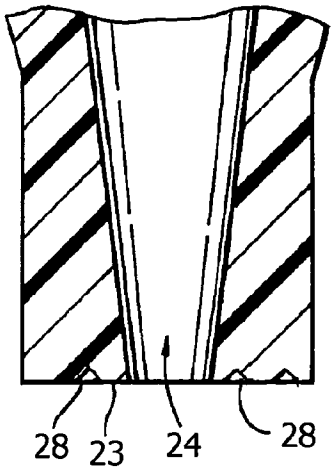
FIG. 22 is a longitudinal cross-sectional view of the tip portion of a fluid metering pipette constructed in accordance with an alternate form of the present invention.
Figure 23:
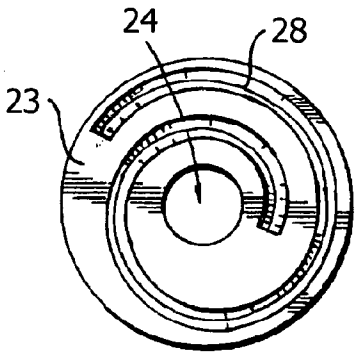
FIG. 23 is a bottom view of the pipette tip of the present invention shown in FIG. 22.

FIGS. 22 and 23 illustrate a form of the pipette tip of the present invention in which a groove 28 is formed in the bottom surface 23 of the pipette tip and spirally disposed thereon about the central opening 24.

Figure 24:
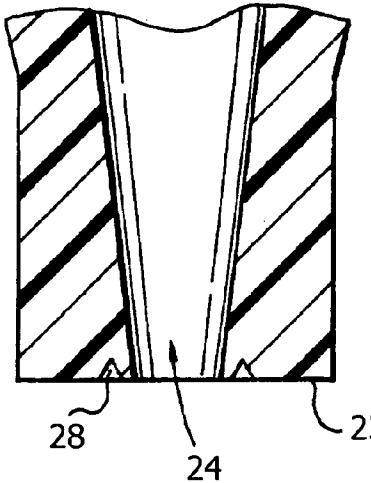
FIG. 24 is a longitudinal cross-sectional view of the tip portion of a fluid metering pipette constructed in accordance with an alternate form of the present invention.
Figure 25:
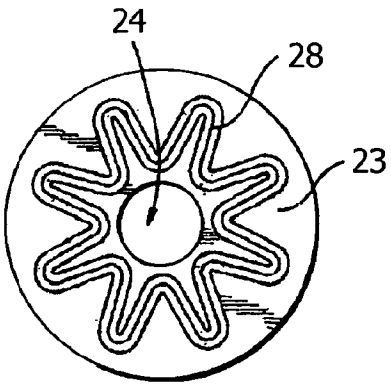
FIG. 25 is a bottom view of the pipette tip of the present invention shown in FIG. 24.

FIGS. 24 and 25 illustrate a pipette tip formed in accordance with another form of the present invention, in which a groove 28 is formed in the bottom surface 23 of the tip and is disposed thereon about the central opening 24 in a serpentine direction with portions thereof extending partially radially inwardly and outwardly on the bottom surface of the pipette tip. The purpose of such a serpentine groove 28, as is the purpose with the grooves formed in the bottom surface 23 of the pipette tip described previously and shown in FIGS. 4-23, is to increase the effective surface area of the bottom surface 23 of the pipette tip, which inhibits the flow of the plasma/serum fluid from the central opening 24 therealong toward the outer surface of the pipette tip in order to minimize the chance of the fluid sample traveling up the outer surface of the sidewall of the pipette tip.

Figure 26:
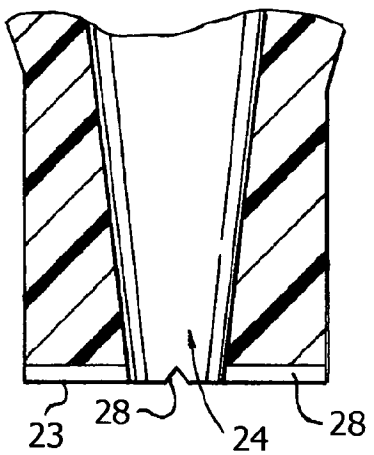
FIG. 26 is a longitudinal cross-sectional view of the tip portion of a fluid metering pipette constructed in accordance with an alternate form of the present invention.
Figure 27:
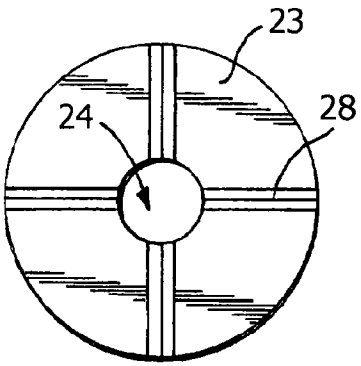
FIG. 27 is a bottom view of the pipette tip of the present invention shown in FIG. 26.

Another form of a pipette tip constructed in accordance with the present invention is illustrated by FIGS. 26 and 27. Here, one or more grooves 28 formed in the bottom surface 23 of the pipette tip may extend radially from the central opening 24 to the outer edge of the bottom surface 23. Again, the radial grooves 28 increase the overall surface area of the bottom surface 23 of the pipette tip, thus inhibiting the flow of sample fluid from the central opening to the outer edge of the bottom surface, where it may have otherwise traveled up the outer surface of the sidewall of the pipette tip and possibly affect the accuracy of the volume of fluid dispensed on a reagent test slide.

Figure 28:
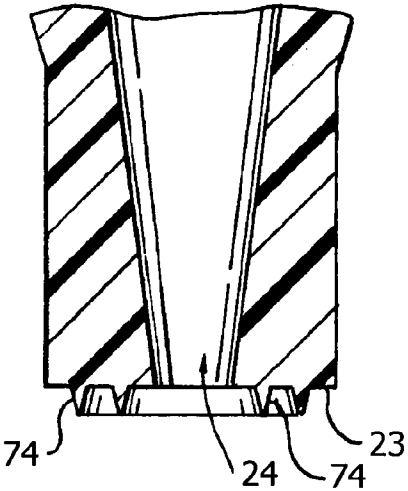
FIG. 28 is a longitudinal cross-sectional view of the tip portion of a fluid metering pipette constructed in accordance with an alternate form of the present invention.

Heretofore, grooves have been described as being formed in the bottom surface 23 of the pipette tip. However, it should be realized that the bottom surface may take on other shapes and features which increase the effective surface area of the bottom surface 23 and thus inhibit the flow of sample fluid from the central opening 24 to the outer edge of the bottom surface 23 of the pipette tip. For example, and as shown in FIGS. 28 and 29 of the drawings, one or more protrusions 74, which may be triangular, rectangular or semi-circular in cross-sectional shape, may be formed on the bottom surface 23 of the pipette tip and extend outwardly therefrom. Such protrusions 74 may be spirally disposed, concentrically disposed or non-concentrically disposed on the bottom surface 23 about the central opening 24 formed in the pipette tip. Such protrusions 74 increase the effective surface area of the pipette tip and thus inhibit the flow of sample fluid from the central opening 24 to the outer edge of the bottom surface 23.

In addition, the bottom surface 23 of the pipette tip of the present invention, with or without grooves, may be convex in shape, to extend axially outwardly from the underside of the pipette tip, as illustrated by FIGS. 30 and 31 of the drawings. The convex shape of the bottom surface 23 of the pipette tip effectively increases the overall surface area of the bottom surface 23 of the pipette tip, thus inhibiting the flow of sample fluid from the central opening 24 to the outer edge of the bottom surface 23 to minimize the possibility of the fluid reaching the outer edge of the bottom surface 23 and traveling up the outer surface of the sidewall of the pipette tip. The convex shaped tip also serves to reduce the volume of fluid that could remain adherent to the pipette tip. For example, if the test slide upon which the fluid is being dispensed has a tendency to repel the fluid, the convex shape decreases the likelihood that an undesirable amount of fluid remains on the tip after application.

The addition of grooves or protrusions formed in the bottom surface 23 of the pipette tip 14 of the present invention, or increasing the overall surface area of the bottom surface, reduces the infrequent problem of spot failure due to the imprecise sample volume dispensing occurring in the conventional pipette design, as the grooves, protrusions or increased surface area inhibit the droplet passing through the opening 24 from flowing towards the outer surface of the sidewall 16 of the pipette tip 14 and traveling up the pipette tip outer surface. A more precise metering of fluid onto the chemical reagent test slide (or into a vial containing a chemical reagent) is realized by the pipette tip of the present invention, even while the pipette tip of the present invention is made from the preferred material, polypropylene, which has an affinity for some fluids, such as blood serum and plasma.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention. In addition, while the preferred embodiments have primarily been discussed as relating to blood chemical analyzers, clearly one skilled in the art of dispensing fluids will appreciate that the present invention has applications outside this field.

What is claimed is:

1. A pipette tip, which comprises:

a main body having an upper end, a lower end disposed axially opposite the upper end and a sidewall extending between the upper end and the lower end and having an outer surface, the main body having formed therein a bore extending axially therethrough between the upper end and the lower end, the lower end having a bottom surface, the bottom surface having an opening formed through the thickness thereof which is in communication with the axial bore to allow the passage of fluid therethrough, the bottom surface further having at least one groove formed therein, the at least one groove acting to inhibit fluid passing through the opening from flowing towards the outer surface of the pipette tip.

2. A pipette tip as defined by claim 1, wherein the at least one groove 1*s* V-shaped in cross-section.

3. A pipette tip as defined by claim 1, wherein the at least one groove is rectangular in cross-section.

4. A pipette tip as defined by claim 1, wherein the at least one groove is semi-circular in cross-section.

5. A pipette tip as defined by claim 1, wherein the at least one groove is concentrically disposed about the opening of the bottom surface of the main body.

6. A pipette tip as defined by claim 1, wherein the at least one groove is spirally disposed about the opening of the bottom surface of the main body.

7. A pipette tip as defined by claim 1, wherein the at least one groove is radially disposed with respect to the opening in the bottom surface of the main body.

8. A pipette tip as defined by claim 1, wherein the at least one groove is disposed on the bottom surface of the main body in a serpentine configuration about the opening.

9. A pipette tip as defined by claim 1, wherein the at least one groove includes a plurality of grooves formed in the bottom surface of the main body of the pipette tip.

10. A pipette tip as defined by claim 1, wherein the at least one groove includes at least a first groove and a second groove formed in the bottom surface of the main body of the pipette tip, the at least first and second grooves having similar shapes in cross-section.

11. A pipette tip as defined by claim 10, wherein the at least first and second grooves are concentrically disposed about the opening.

12. A pipette tip as defined by claim 11, wherein the at least first and second grooves are spirally disposed about the opening.

13. A pipette tip as defined by claim 1, wherein the at least one groove includes at least a first groove and a second groove formed in the bottom surface of the main body of the pipette tip, the first groove being situated on the bottom surface radially inwardly of the second groove, the first groove having a first cross-sectional dimension, the second groove having a second cross-sectional dimension, the first cross-sectional dimension of the first groove being different from the second cross-sectional dimension of the second groove.

14. A pipette tip as defined by claim 13, wherein the first and second grooves are concentrically disposed about the opening.

15. A pipette tip as defined by claim 13, wherein the first cross-sectional dimension of the first groove is less than the second cross-sectional dimension of the second groove.

16. A pipette tip, which comprises:

a main body having an upper end, a lower end disposed axially opposite the upper end and a sidewall extending between the upper end and the lower end, and having an outer surface, the main body having formed therein a bore extending axially therethrough between the upper end and the lower end, the lower end having a bottom surface, the bottom surface having an opening formed through the thickness thereof which is in communication with the axial bore to allow the passage of fluid therethrough, the bottom surface further having means for inhibiting fluid passing through the opening from flowing towards the outer surface of the pipette tip, the inhibiting means including at least one groove formed in the bottom surface, wherein the groove is continuous and circular in shape.

17. The pipette tip according to claim 1, wherein the bottom surface of the main body further includes an increase in material between the opening and the outer surface of the pipette tip to further inhibit fluid passing through the opening from flowing towards the outer surface of the pipette tip.

18. The pipette tip according to claim 1, wherein the bottom surface of the pipette tip is at least one of flat and convex.

19. A pipette tip as defined by claim 1, wherein the main body further includes at least one protrusion situated on the bottom surface and extending outwardly therefrom.

20. A pipette tip as defined by claim 19, wherein the at least one protrusion is continuous and circular in shape.

* * * * *